United States Patent [19]

Teraoka

[11] Patent Number: 4,678,432

[45] Date of Patent: Jul. 7, 1987

[54] HEAT TREATMENT METHOD

[75] Inventor: Hideyuki Teraoka, Hikone, Japan

[73] Assignee: Dainippon Screen Mfg. Co., Ltd., Kyoto, Japan

[21] Appl. No.: 772,780

[22] Filed: Sep. 5, 1985

[30] Foreign Application Priority Data

Nov. 26, 1984 [JP] Japan ..... 59-248889

[51] Int. Cl.[4] ..... F27D 13/00

[52] U.S. Cl. ..... 432/12; 432/24

[58] Field of Search ..... 432/12, 24

[56] References Cited

U.S. PATENT DOCUMENTS 3,623,712 11/1971 McNeilly et al. ..... 34/4

FOREIGN PATENT DOCUMENTS

83/02314 7/1983 European Pat. Off. ..... 432/12
53-120075 10/1978 Japan .
57-147237 9/1982 Japan .
58-70536 4/1983 Japan .

*Primary Examiner*—Henry C. Yuen
*Attorney, Agent, or Firm*—Brumbaugh, Graves, Donohue & Raymond

[57] ABSTRACT

A heat treatment method in which a heating furnace is preliminarily heated before carrying an object to be heat-treated in the furnace and an unit heating process is repeated at least twice according to an output program for controlling an output of a heating light source which is stored in a memory so that the heat treatment is uniformly applied to every object to be heat treated.

4 Claims, 6 Drawing Figures

HEAT TREATMENT METHOD

BACKGROUND OF THE INVENTION

1. Field of the Invention

This invention relates to a heat treatment method in which such material as a semiconductor substrate (hereinafter referred to as "wafer") is heat-treated by irradiating both front and back sides thereof with light, and more particularly to a heat treatment method by which a heat treatment is uniformly applied to every wafer when a plurality of wafers are taken in a heating furnace one by one and heat-treated therein.

2. Prior Art

Generally, the heat treatment process of the wafer is widely used in varieties of heat treatments, i.g., a heat treatment for activating and uniformly composing an ion implanted layer as an after-treatment of ion implantation, a heat treatment for stabilizing a silicon film, etc.

In any of these heat treatments, it is required for every surface of the wafer including front and back sides thereof to be uniformly heated, and accordingly in view of rapid heat treatment, in case of using such heating means as halogen lamp for the irradiation with light, it is indispensable to secure uniformity of irradiation applied from such heating light source to the wafer.

As for the method of securing said uniformity in the distribution of irradiation, it is well known so far that, as is disclosed in Japanese laid open Patent Publication (unexamined) Sho 57-147237, a wafer accepted in a heating furnace is horizontally carried in relation to the light source, otherwise the wafer is horizontally carried at specified amplitude.

In case of securing the uniform irradiation by using such method, however, there exists such problem that, at the time immediately after starting the heat treatment operation, i.e., when the atmosphere in the furnace has not been uniformly heated yet, a result of heat treatment (annealing effect) of the first one of the prearranged wafer is different from that of the following several wafers, which is a serious problem in view of product quality.

As for the method of controlling the atmosphere in the furnace at required temperature, several attempts have been proposed as disclosed in Japanese laid open Patent Publication (unexamined) Sho 53-120075 or Sho 58-70536.

Further, the applicant has already proposed a heat treatment method by filing a Japanese Patent Application Sho 59-105571 wherein the furnace is preliminarily heated before an object to be heat-treated is placed in the furnace based on an output program for controlling the output of the light source which is preliminarily stored in a memory.

According to the methods disclosed in aforementioned Publications Sho 53-120075 and Sho 58-70536, in the event of shutting down the heat treatment operation for long period and restarting it afterward, there arises such disadvantage that the annealing effect, i.e., product quality of the wafer heat-treated before the shutdown is different from that of the wafer heat-treated after the restarting.

Aforementioned Japanese Patent Application Sho 59-105571 was filed for the purpose of solving the above-discussed disadvantage.

SUMMARY OF THE INVENTION

It is an object of this invention to improve further the method of preceding Application Sho 59-105571, providing a novel heat treatment method whereby every wafer is uniformly heat treated.

The foregoing object is accomplished by providing a method of heat treatment in which a heating furnace is preliminarily heated before carrying an object to be treated into the furnace based on an output program for controlling an output of a heating light source which is preliminarily stored in a memory, and an unit heating process is repeated at least twice according to this program. This unit heating process is also characterized by establishing a preheating termination point to come when an elapsed time becomes an almost certain value, said elapsed time being counted from the point of time when the furnace temperature rises to a first setup temperature to the point of time when the furnace temperature drops to a second setup time after reaching the peak thereof. In other words, this invention is to provide a heat treatment method in which an object to be heat-treated is carried in a heating furnace and is heat-treated by irradiation with light emitted from light source disposed facing to each of front side and back side of each object to be heat-treated, being characterized in that said furnace is preliminarily heated by repeating an unit heating process at least twice before carrying the object in the furnace based on an output program for controlling an output of the light sources which is preliminarily stored in a memory, and that said unit heating process comprising a step of measuring a time elapsed from the point of time when reaching a first setup temperature in the course of rise in the furnace temperature to the point of time when reaching a second setup temperature in the course of falling down in the furnace temperature, a step of comparing the measured time with the time measured in the same manner with regard to the unit heating process completed immediately before, and a step of establishing a preheating termination point so as to come at the point of time when an absolute value of a difference obtained by the comparison remains within a specified value.

Thus, in the course of repeating each unit heating process based on the output program for controlling the output of the light source in which the furnace temperature rises, reaches a certain peak and falls therefrom, since the furnace is preheated until the required time elapsed from the point of time to reach the first setup temperature in the course of temperature rise to the point of time to reach the second setup temperature in the course of temperature fall becomes almost constant or stabilized, the atmosphere in the furnace can be always put under the same conditions for every object to be treated, at the time of preheating, i.e., carrying the objects to be heat-treated in the furnace.

In association with the foregoing arrangement and function, following advantages are performed by this invention.

(1) In comparison with the known preheating method effected simply by repeating a required number of preheating times or by setting up a required heating time, according to this invention, the conditions at the time of completing the preheating are clearly established and the unit heating process is repeated until those conditions are satisfied so that the furnace is exactly put under the uniform temperature condition when it is preheated, and as a result in the process of consecutively heat-treating the objects one by one, the conditions of starting the heat-treatment become uniform or equal to every object, thereby being possible to secure an uniformity of product quality. In addition, even in the event of stopping the consecutive automatic heat treatment operation temporarily and restarting it afterward, there is no difference of product quality among the heat-treated objects.

(2) Since the preheating is completed at the time when the difference of the time required in the unit preheating process comes within a certain range of value, there are no such disadvantages as losing time in the preheating, insufficient preheating and the like, and in effect a quite economical and exact heat treatment control can be performed.

(3) In the event of changing the configuration of the heating furnace or adding some accessory thereto, the temperature condition of the furnace at the time of completing the preheating can remain unchanged, and as a result the product quality is prevented from influence by such change or addition.

BRIEF DESCRIPTION OF THE DRAWINGS

Other objects, features and disadvantages of this invention will be seen in conjunction with the accompanying drawings wherein.

DESCRIPTION OF THE PREFERRED EMBODIMENT

Referring now to the accompanying drawings, an embodiment of this invention is described in detail hereunder.

Figure 1:
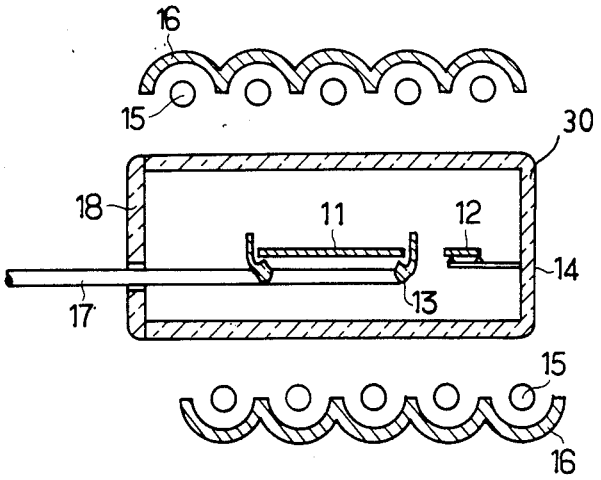
FIG. 1 is a sectional view of a principal part of a heat treatment apparatus to which the method of this invention is applied as an embodiment.
Figure 2:
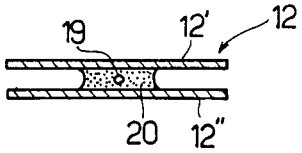
FIG. 2 is a sectional view of a wafer for use as a monitor (a monitoring wafer) which is set to said apparatus.

In FIG. 1 showing a sectional view of a principal part of a heat treating apparatus used in association with this invention, a wafer (11) which is an object to be heat-treated is placed on a wafer holder (13) and moved from left to right together with a left side wall (18) of a heating furnace (14), thus being carried into the furnace (14). A monitoring wafer (12) is disposed on the same plane with the wafer (11) in the heating furnace (14). This monitoring wafer (12) is, for example, composed of a pair of pieces (12'), (12") of the same material as wafer (11) being superposed each other, a heat-conductive bonding agent (20) being put therebetween, and a thermocouple (19) being inserted further therein, as is shown in the sectional view of FIG. 2. The thermocouple (19) can be also disposed being in contact with the inner wall of the furnace (14).

A light source (15) such as halogen lamp is disposed at specified pitches above and under transparent walls (30) of the heating furnace (14) being faced to both upper side and lower side of the wafer, and corresponding reflecting plates (16) are respectively disposed on the back side of each light source (15). An arm (17) which is integrally fixed to one end of the wafer holder (13) reciprocatingly slides through a hole provided on the side wall (18), the wafer holder (13) being horizontally moved thereby.

Figure 3:
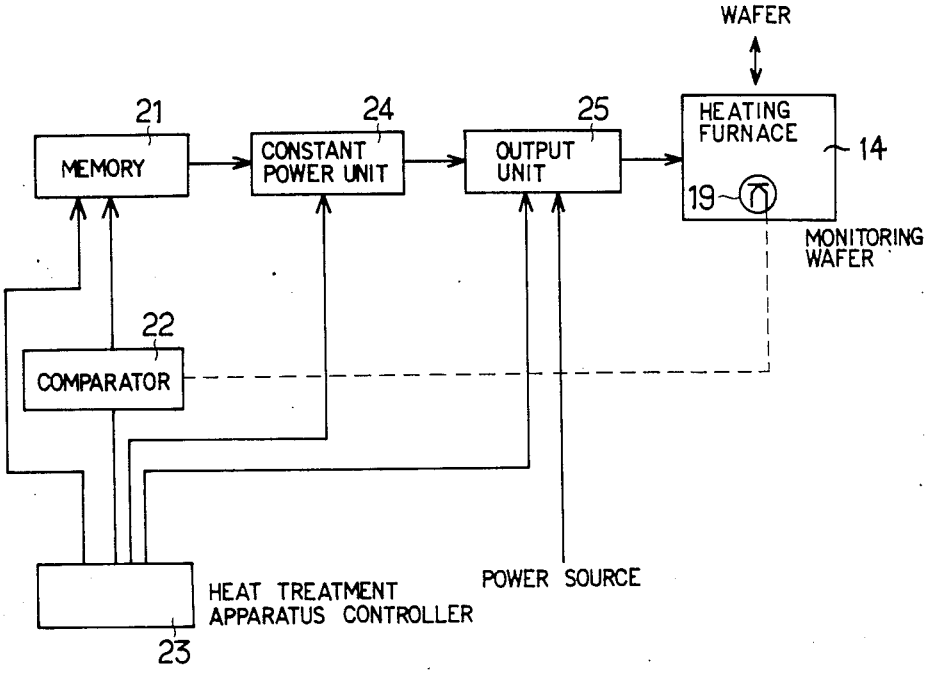
FIG. 3 is a block diagram of a control system of said apparatus.

In FIG. 3 showing a block diagram of a substantial arrangement of a control system for use in the above-described heat treating apparatus, a memory (21) includes a RAM (or bubble memory, floppy disk, etc.), and an output program is stored therein for controlling the output of the light source (15) when preheating the heating furnace (14) or when heat-treating the wafer (11).

A comparator (22) is a device for comparing a surface temperature of the monitoring wafer (12) with a specified temperature setup value, and making a signal which directs the apparatus to start preheating the furnace (14) or heat treatment of the wafer (11) based on the output program stored in the memory (21) at the time when the surface temperature of the monitoring wafer (12) exceeds the setup value. When the signal is delivered to the memory (21), the output of the light source (15) is controlled by the output program stored in the memory (21).

A constant power unit (24) is provided for preventing from being directly influenced by the voltage fluctuation at the time of controlling the output of the light source (15) according to the output program stored in the memory (21). This constant power unit (24) detects the output of the source (15) by every half cycle of the power source frequency and controls the power supplied to the light source (15) corresponding to the output signal. An output unit (25) has a thyristor SCR therein and controls the output of the source (15) corresponding to the output of the constant power unit (24). Each of the above-described units are coordinately controlled by heat-treating apparatus controller (23).

Figure 4:
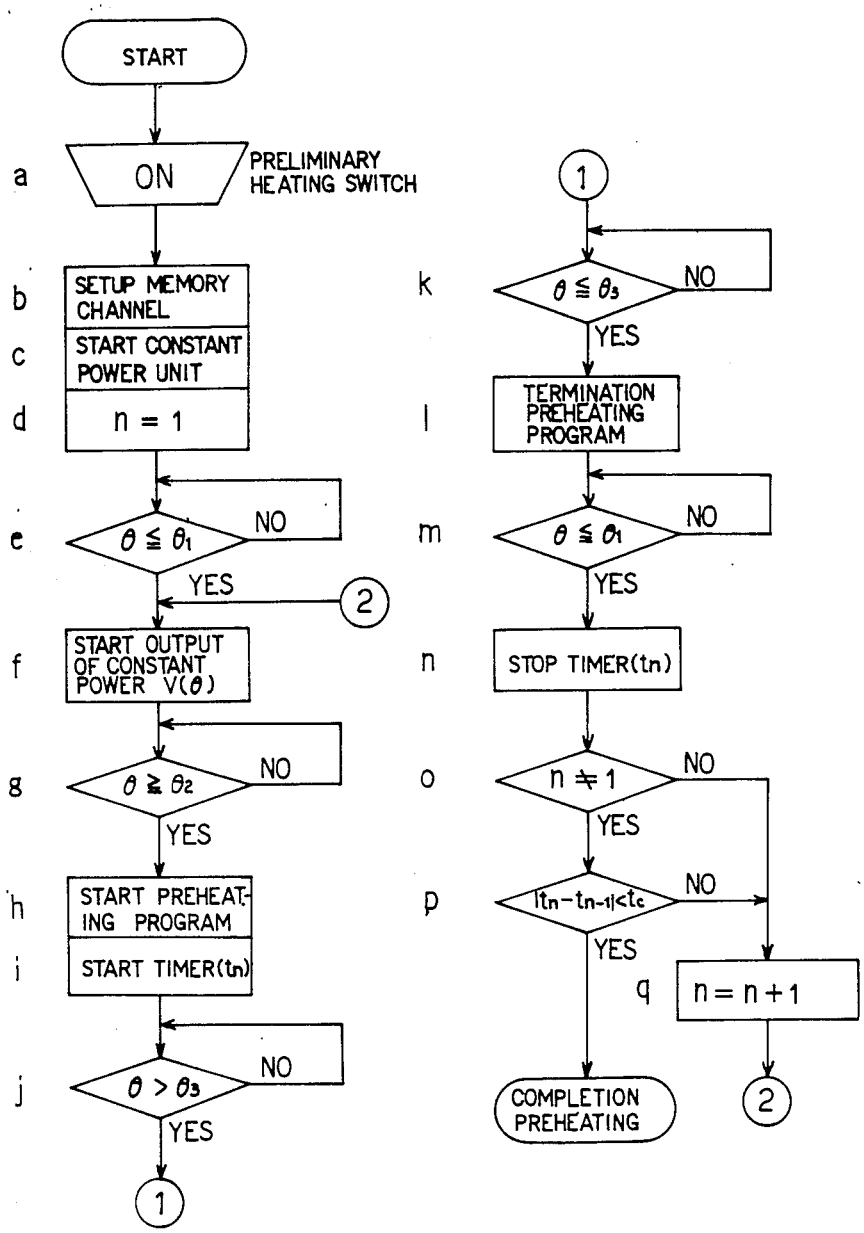
FIG. 4 is a flow chart for explaining the preheating process of the heat treatment method of this invention.

FIG. 4 is a flow chart for explaining a heat treating method as an embodiment of this invention, particularly a preheating process taken place before carrying the wafer (11) in the heating furnace (14).

In this preheating process, only the monitoring wafer (12) is accepted in the heating furnace (14) which is in the closed state. Under such conditions, when a preheating switch (not shown) mounted on the controller (23) is turned on (step a in FIG. 4), a program in the memory (21) is automatically set up to "preheating" (step b in FIG. 4), and at the same time the constant power unit (24) is started, thus being ready to supply the constant power to the light source (15) (step c in FIG. 4). Then the number of times n for performing an unit heating process is set up to 1 (step d in FIG. 4), and after confirming that the temperature $\theta$ of the furnace (14) detected by means of the thermocouple (19) disposed in the monitoring wafer (12) is lower than the temperature $\theta_1$ which permits the wafer (11) to be carried in the furnace (14), a certain power V ($\theta_2$) is supplied from the output unit (25) to the light source (25) corresponding to the output from the constant power unit (24) (step f in FIG. 4).

Figure 5:
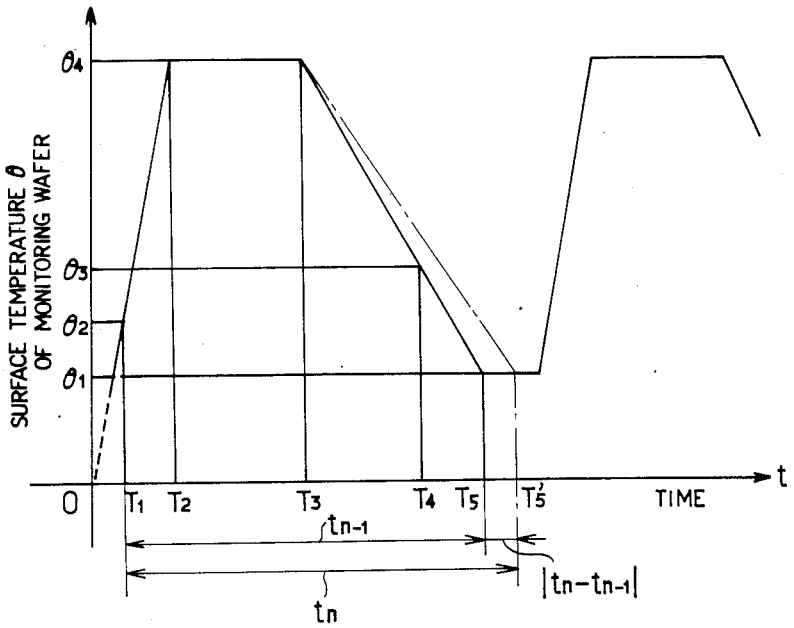
FIG. 5 is a graph showing the transition of surface temperature of said monitoring wafer in the preheating process.
Figure 6:
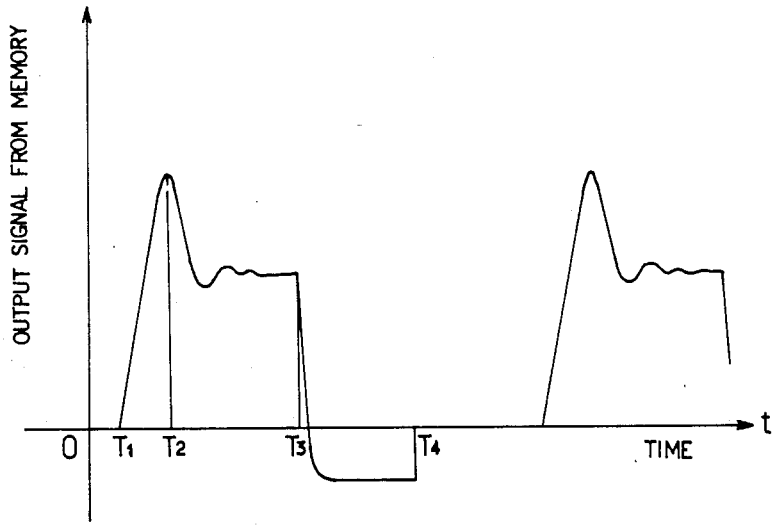
FIG. 6 is a graph showing the transition of output signal from a memory in the preheating process.

Then, as is shown in FIG. 5, when the surface temperature $\theta$ of the monitoring wafer (12) in the furnace (14) rises and comes to reach and exceed the first setup temperature $\theta_2$ after time $T_1$ thereby a signal being delivered from the comparator (22) to the memory (21) (step g in FIG. 4), an output signal as is shown in FIG. 6, for example, and which is stored in the preheating program of the memory (21) is given (step h in FIG. 4), then a power almost in proportion to this output signal is supplied to the light source (15) in place of the constant power fed until then, and simultaneously with the start of such supply a timer is also started (step i in FIG. 4).

In this connection, it is noted that a certain setup power is supplied to the light source (15) during the period of rising the surface temperature of the monitoring wafer (12) from $\theta$ to $\theta_2$ because atomospheric conditions such as initial temperature may be occasionally different at the time of starting the preheating. Therefore, as is described above, it is not until the surface temperature $\theta$ monitoring of the wafer (12) comes to exceed $\theta_2$ that readout of the "preheating program" is started.

Then, as is shown in FIG. 5, the surface temperature once exceeds $\theta_3$ (step j in FIG. 4) and reaches $\theta_4=1{,}000°$ C. after time $T_2$ for example, this temperature $\theta_4$ is kept for a while from $T_2$ to $T_3$. When elapsing the time $T_3$, the power supply to the light source (15) is stopped, the surface temperature $\theta$ of the monitoring wafer (12) is decreased, and at the moment of $\theta \leqq \theta_3$ after $T_4$ time (step k in FIG. 4), the preheating program is completed (step 1 in FIG. 4).

When the surface temperature $\theta$ is further decreased to the second setup temperature $\theta_1$, i.e., 400° C. and below (step m in FIG. 4), the timer stops (step n in FIG. 4). Thus one cycle of the unit heating process or preheating is completed, and then it is checked whether the completed process is the first one or not (step o in FIG. 4). When confirmed it is the first process, the number of times of the unit heating process is set up to 2 (step q in FIG. 4), and the steps f to n in FIG. 4 are repeated. In this connection, it is preferred that the second setup temperature $\theta_1$ is either the same as the first setup temperature $\theta_2$ or lower than it, and when setting up the former $\theta_1$ to be higher than the latter $\theta_2$, it becomes necessary to wait until the former $\theta_1$ falls down to the level of the first setup temperature $\theta_2$ in order to be ready for the next preheating.

Then, the time $t_1$ of the first process is compared with the time $t_2$ of the second process, both measured by the timer with respect to the period elapsed from the moment $T_1$ when the surface temperature $\theta$ of the monitoring wafer (12) reaches the first setup temperature $\theta_2$ till the moment $T_5$, ($T_5'$) when it comes down to the second setup temperature $\theta_1$, and it is checked whether an absolute value of the difference $\Delta t=t_2-t_1$ is within a specified value $t_c$ (i.e., $t_c=1$ sec.) (step p in FIG. 4). By this checking, if it is confirmed that the absolute value $|\Delta t|$ is $t_c$ and less, the preheating is terminated at this point, and if not, the number of times of the unit heating process for preheating is to be set up to [$n=n+1$(step q in FIG. 4)], and the steps f to p in FIG. 4 are further repeated.

In such case, the time $t_2$ measured as to the second process is longer than the time $t_1$ measured as to the first process, and in the same way the time $t_3$ is longer than the time $t_2$, while the absolute values of the time lags thereof becomes gradually smaller. Thus, establishing that the temperature in the furnace (14) becomes almost constant at the time when the absolute value $|\Delta t|=|t_n-t_{n-1}|$ (i.e., 1 sec.) which is a difference between the time $t_n$ measured as to the (n)th unit heating process and the time $t_{n-1}$ measured as to the previous (n−1)th process becomes smaller than $t_c$, the preheating is completed.

After the completion of the preheating, the temperature in the furnace (14) is kept at the second setup temperature $\theta_1$, and at this second setup temperature $\theta_1$, the wafer (11) is carried in the furnace (14) to be heat-treated one after another. With regard to the automatic heat treating process, the description is omitted herein since it has no particular relation with this invention.

In addition, as to the output program used in the above-described preheating process, either the same one as the output program for use in the heat treatment of the wafer (11) in the automatic heat treatment process or the other adequate output program is available.

I claim:

1. In a method for heat treating an object wherein the object is carried into a heating furnace and is heat-treated by irradiation with light which is emitted from a light source disposed facing at least one side of said object in accordance with an output program which calls for a rise in temperature followed by a decrease in temperature, the improvement comprising:

(a) preheating the furnace prior to carrying the object into the furnace by irradiating the furnace with light in accordance with the output program;

(b) measuring a first elapsed time between a first time when a first set-up temperature is reached in the course of the rise of furnace temperature, and a second time when a second set-up temperature is reached in the course of the decrease in furnace temperature;

(c) repeating a cycle of steps a and b to measure a second elapsed time;

(d) comparing the difference between the first elapsed time and the second elapsed time with a specified value, wherein if the difference between the first elapsed time and the second elapsed time is less than the specified value the preheating is terminated and an object is carried into the furnace, and wherein if the difference between the first elapsed time and the second elapsed time is greater than the specified value, step c is repeated to measure a subsequent elapsed time which is compared according to step d with the elapsed time measured in the immediately preceding cycle.

2. A method according to claim 1, wherein the furnace is maintained at the second set-up temperature while the object is carried into the furnace.

3. A method according to claim 1, wherein the first set-up temperature is greater than or equal to the second set-up temperature.

4. A method according to claim 1 or 2, wherein the second set-up temperature is less than 400° C.

* * * * *